US009012801B2

(12) United States Patent
Yang

(10) Patent No.: US 9,012,801 B2
(45) Date of Patent: Apr. 21, 2015

(54) FLEXIBLE SHUNT FOR VACUUM CIRCUIT BREAKER

(75) Inventor: Seung Pil Yang, Cheongju-Si (KR)

(73) Assignee: LSIS Co., Ltd., Anyang-Si, Gyeoggi-Do (KR)

( * ) Notice: Subject to any disclaimer, the term of this patent is extended or adjusted under 35 U.S.C. 154(b) by 465 days.

(21) Appl. No.: 13/358,436

(22) Filed: Jan. 25, 2012

(65) Prior Publication Data

US 2012/0199557 A1 Aug. 9, 2012

(30) Foreign Application Priority Data

Feb. 8, 2011 (KR) ..... 10-2011-0011249

(51) Int. Cl.
*H01H 33/66* (2006.01)
*H01H 1/58* (2006.01)

(52) U.S. Cl.
CPC ..... *H01H 33/6606* (2013.01); *H01H 1/5822* (2013.01); *H01H 2001/5827* (2013.01); *H01H 2033/6613* (2013.01)

(58) Field of Classification Search
CPC ..... H01H 33/666; H01H 33/66; H01H 1/58; H01H 33/6602; H01H 33/5822
USPC ..... 218/118–121, 134, 137, 139, 152–155; 200/50.27; 361/652, 673, 676
See application file for complete search history.

(56) References Cited

U.S. PATENT DOCUMENTS 3,542,987 A 11/1970 Levy
4,144,554 A 3/1979 Erickson
4,384,179 A * 5/1983 Milianowicz ..... 218/118
6,444,939 B1 * 9/2002 Crookston et al. ..... 218/140
8,089,021 B2 * 1/2012 Kagawa ..... 218/140
8,115,124 B2 * 2/2012 Maruyama et al. ..... 200/50.27

FOREIGN PATENT DOCUMENTS

| | | |
|---|---|---|
| CN | 1200551 | 12/1998 |
| CN | 1072384 | 10/2001 |
| CN | 1222964 | 10/2005 |
| GB | 1590698 | 6/1981 |
| JP | 06208821 | 7/1994 |

(Continued)

OTHER PUBLICATIONS

Japan Patent Office Application Serial No. 2012-012154, Office Action dated Jan. 8, 2013, 3 pages.

(Continued)

*Primary Examiner* — Amy Cohen Johnson
*Assistant Examiner* — Marina Fishman
(74) *Attorney, Agent, or Firm* — Lee, Hong, Degerman, Kang & Waimey

(57) ABSTRACT

A flexible shunt for a vacuum circuit breaker can have a reduced straight length and improved flexibility even with an increased thickness within a predetermined accommodation space of a main circuit part. The flexible shunt comprises a pair of conductive plates, each including a clamp connecting portion configured as a flat conductive member, the clamp connecting portion being connected the clamp, a terminal side connecting portion configured as a flat conductive member, the terminal side connecting portion being connected to the terminal side, and a flexible curved portion configured to connect the clamp connecting portion to the terminal side connecting portion, the flexible curved portion being formed to be projected outwardly.

3 Claims, 4 Drawing Sheets

(56) References Cited

FOREIGN PATENT DOCUMENTS

| | | |
|---|---|---|
| JP | 10321096 | 12/1998 |
| JP | 2004312824 | 11/2004 |
| KR | 10-0996791 | 11/2010 |
| SU | 653649 | 3/1979 |
| WO | 01/86675 | 11/2001 |

OTHER PUBLICATIONS

Russian Federation Federal Service for Intellectual Property, Patents and Trademarks Application Serial No. 2012104228/07, Notice of Allowance dated Sep. 18, 2013, 5 pages.

State Intellectual Property Office of the People's Republic of China Application Serial No. 201210029461.2, Office Action dated Feb. 11, 2014, 6 pages.

* cited by examiner

FLEXIBLE SHUNT FOR VACUUM CIRCUIT BREAKER

CROSS-REFERENCE TO RELATED APPLICATION

Pursuant to 35 U.S.C. §119(a), this application claims the benefit of earlier filing date and right of priority to Korean Application No. 10-2011-0011249, filed on Feb. 8, 2011, the contents of which is herein expressly incorporated by reference in its entirety.

BACKGROUND OF THE INVENTION

1. Field of the Invention

This disclosure relates to a vacuum circuit breaker, and particularly, to a flexible shunt for providing a conductive path between a movable electrode side and a main circuit terminal in a vacuum circuit breaker.

2. Background of the Invention

A vacuum circuit breaker is a kind of electric power equipment for opening or closing a conductive path of an ultrahigh voltage to high voltage of a power station or an electric power substation and protecting a circuit and an electric load side devices connected to the circuit by breaking the circuit upon occurrence of a fault current on the circuit.

In general, a vacuum circuit breaker is embedded in a distributing board, which includes an instrument and monitoring device such as a digital relay, and a plurality of circuit breakers, for monitoring states of the electric power and lines.

Since the vacuum circuit breaker is typically used by being embedded in the distributing board, a pull-out type vacuum circuit breaker having a carriage, which is movable for facilitation of installation and maintenance thereof.

The pull-out type vacuum circuit breaker roughly includes, for each of three phases (poles), a circuit breaker main body (abbreviated as main body hereinafter) provided with a contact part called as a vacuum interrupter, a switching mechanism for opening or closing the contact part, and a terminal part electrically connected to the contact part, the main body movable by the carriage having wheels, and a cradle for supporting the main body, the cradle having a first terminal part connected to the terminal part of the main body, and a second terminal part electrically connected to an external electric power circuit, the cradle fixed into a power distributing board.

Hereinafter, description will be given of an outer appearance of the main body of the pull-out type vacuum circuit breaker according to one exemplary embodiment with reference to FIG. 1. The cradle is a housing having the first terminal part and the second terminal part, and less relevant to the present disclosure. So, the cradle will not be illustrated and described in detail.

As shown in FIG. 1, a main body 100 may be installed on a carriage having wheels (no reference number given) to be movable back and forth. The main body 100 may include a front cover 10, a main body housing 20, a main circuit part 30 and terminal parts 32*a* and 40*a*. The terminal parts 32*a* and 40*a* may include an upper terminal 32 and a lower terminal 40 to be explained with reference to FIG. 2, and finger contactors of terminal end portions (no reference numeral given) of the upper terminal 32 and the lower terminal 40.

The main body 100 may be movable to a connected position at which the terminal parts 32*a* and 40*a* are connected to the first terminal part of the cradle, a test position at which the terminal parts 32*a* and 40*a* are separated from the first terminal part of the cradle due to the main body 100 being drawn out by the carriage but a electric power supply and signal line connection are maintained with respect to a controller (i.e., a controller (no reference numeral given) located at the rear of the front cover 10 of FIG. 1, and called as Over Current Relay (OCR) in the related field), and a disconnected position at which the main body 100 is further drawn out by the carriage such that the terminal parts 32*a* and 40*a* are separated from the first terminal part of the cradle and the electric power supply and signal line connection with respect to the controller are disconnected.

The present disclosure relates to a flexible conductor, so-called a flexible shunt, which provides a flexible electric connection unit for electrically connecting a movable shaft, which is connected to a movable contact, and a terminal and simultaneously allows for movement of the movable shaft. Hereinafter, description will be given of the corresponding flexible shunt according to the related art with reference to FIG. 2.

A main circuit part 30 having the related art flexible shunt includes a vacuum interrupter 33 as a contact part, an upper terminal 32 and a lower terminal 40 electrically connected to a stationary contact 34 and a movable contact 35 of the vacuum interrupter 33, respectively, a movable shaft 35*a* (so-called movable electrode) 35*a*, a connection rod 41 and a push rod 42 acting together as a vertical driving unit to vertically drive the movable contact 35 to a connected position where the movable contact 35 contacts the stationary contact 34 or a connected position where the movable contact 35 is separated from the stationary contact 35, a link 44 acting as a driving unit disposed at the main body side of FIG. 1 to transfer a switching driving force from a switching mechanism (not shown) to the vertical driving unit, a contact spring to apply contact pressure to the push rod 42 upwardly in the drawing such that the movable contact 35 maintains the contact state at the connected position, a clamp 36 having the movable shaft 35*a* inserted therein for heat emission to prevent overheat of the movable shaft 35*a*, a heat sink 37 integrally installed on the clamp 36, and a flexible shunt 38' having one end connected to the clamp 36 and the other end connected to the lower terminal 40 so as to electrically connect the lower end 40 and the movable contact 35 to each other. A reference number 31 designates a main circuit part housing as a housing for accommodating those components of the main circuit part 30.

In the vacuum circuit breaker according to the related art, the flexible shunt 38', which electrically connects the movable shaft 35*a* connected to the movable contact 35 to the lower terminal 40, is configured by twisting several strands of copper wires or stacking and pressing several sheets of copper thin plates.

As the vacuum circuit breaker became larger, an amount of current increased, which resulted in an increase in a thickness of the flexible shunt 38'. However, since the flexible shunt 38' should be moved with the one end being connected to the clamp 36, which moved together with the movable shaft 35*a*, flexibility was required. Hence, a length of the flexible shunt 38' increased for ensuring the flexibility.

However, the related art flexible shunt 38' caused an increase in the size of the vacuum circuit breaker due to the increase in its length, which resulted in an increase in a fabricating cost of the vacuum circuit breaker.

SUMMARY OF THE INVENTION

Therefore, to address those problems of the related art, an aspect of the detailed description is to provide a flexible shunt for a vacuum circuit breaker, capable of decreasing a straight length and increasing flexibility with increasing a thickness thereof within a predetermined accommodation space.

To achieve these and other advantages and in accordance with the purpose of this disclosure, as embodied and broadly described herein, there is provided a flexible shunt for a vacuum circuit breaker having a vacuum interrupter, a movable shaft, a heat sink, a clamp to connect the heat sink to the movable shaft, and a terminal connected to a power source side or load side electric circuit, the flexible shunt comprising: a pair of conductive plates, wherein each of the conductive plates comprises:

a clamp connecting portion configured as a flat conductive member, the clamp connecting portion being connected the clamp;

a terminal side connecting portion configured as a flat conductive member, the terminal side connecting portion being connected to the terminal side; and a flexible curved portion configured to connect the clamp connecting portion to the terminal side connecting portion, the flexible curved portion being projected outwardly.

In an aspect of the detailed description, each of the clamp connecting portion and the terminal side connecting portion may comprise a plurality of coupling hole portions for allowing coupling of fixing members including screws.

In another aspect of the detailed description, the flexible shunt may further comprise a shunt fixing block interposed between the terminal side connecting portion and the terminal to fix the terminal side connecting portion to the terminal, the shunt fixing block being made of a conductive material.

In another aspect of the detailed description, each of the conductive plates may comprise a plurality of electrically conductive thin plates that are stacked and pressed.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this disclosure, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
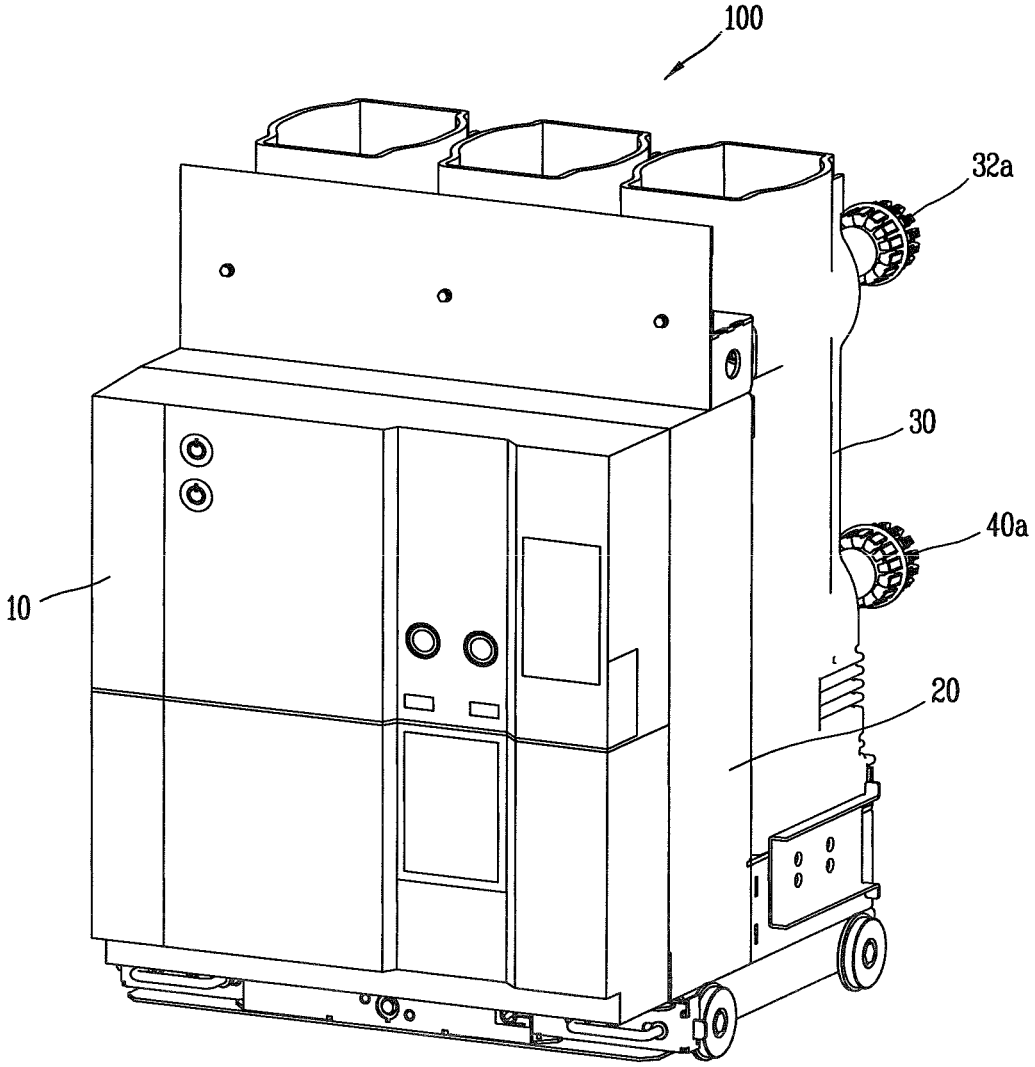
FIG. 1 RELATED ART
FIG. 1 is a perspective view showing an outer appearance of a main body for a typical pull-out type vacuum circuit breaker to which a flexible shunt is to be applied.
Figure 2:
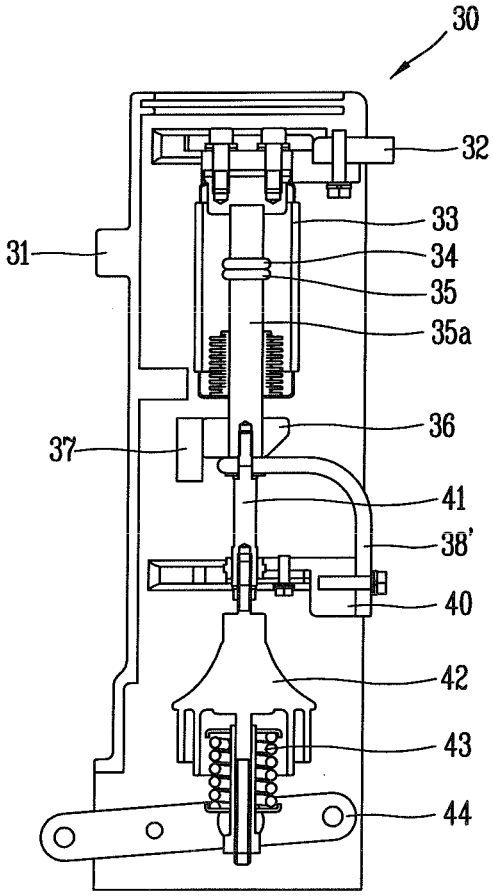
FIG. 2 RELATED ART
FIG. 2 is a longitudinal sectional view of a main circuit part for the vacuum circuit breaker, which shows a flexible shunt and related components according to the related art.

A vacuum circuit breaker, to which a flexible shunt according to the present disclosure, has been shown in FIG. 1, so description thereof will not be repeated.

Hereinafter, description will be given of a configuration of a main circuit part, which is a part more improved than the related art, in a vacuum circuit breaker having a flexible shunt according to the present disclosure, with reference to FIG. 3.

Figure 3:
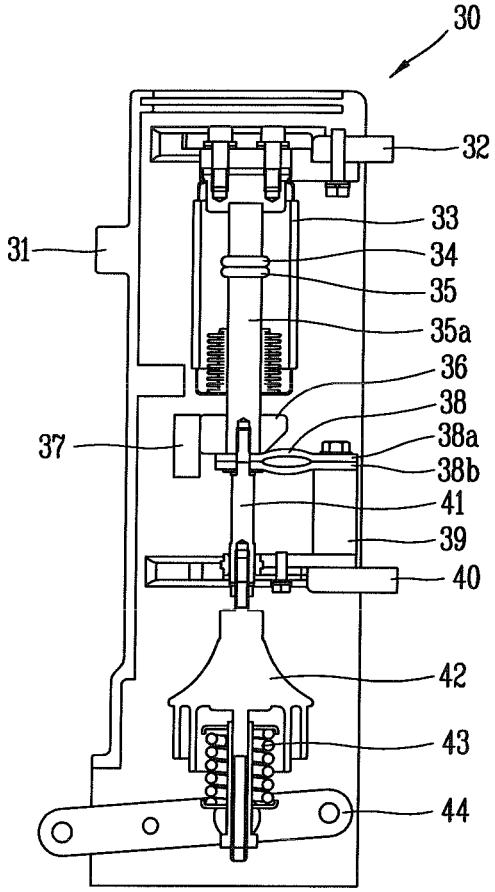
FIG. 3 is a longitudinal sectional view showing a flexible shunt and related components of a main circuit part in a vacuum circuit breaker in accordance with one exemplary embodiment of this disclosure, which shows a contact state between contacts.

As shown in FIG. 3, a main circuit part 30 having a flexible shunt according to the present disclosure may comprise a vacuum interrupter 33 as a contact part, an upper terminal 32 and a lower terminal 40 electrically connected to a stationary contact 34 and a movable contact 35 of the vacuum interrupter 33, respectively, a movable shaft 35*a* (so-called movable electrode) 35*a*, a connection rod 41 and a push rod 42 acting together as a vertical driving unit to vertically drive the movable contact 35 to a connected position where the movable contact 35 contacts the stationary contact 34 or a connected position where the movable contact 35 is separated from the stationary contact 35, a link 44 acting as a driving unit disposed at the main body side of FIG. 1 to transfer a switching driving force from the switching mechanism (not shown) to the vertical driving unit (i.e., 35*a*, 41 and 42), a contact spring to apply contact pressure to the push rod 42 upwardly in the drawing such that the movable contact 35 maintains the contact state at the connected position, a clamp 36 having the movable shaft 35*a* inserted therein for heat emission to prevent overheat of the movable shaft 35*a*, a heat sink 37 integrally installed on the clamp 36, and a flexible shunt 38 having one end connected to the clamp 36 and the other end connected to the lower terminal 40 so as to electrically connect the lower end 40 and the movable contact 35 to each other. A reference number 31 designates a main circuit part housing as a housing for accommodating those components of the main circuit part 30.

The flexible shunt 38 according to the present disclosure may comprise a pair of conductive plates 38*a* and 38*b* installed to face each other. Each of the conductive plates 38*a* and 38*b* may be configured by stacking and pressing a plurality of electrically conductive thin plates.

Each of the conductive plates 38*a* and 38*b* constructing the flexible shunt 38 may comprise a clamp connecting portion 38*a*1 or 38*b*1, a terminal side connecting portion 38*a*3 or 38*b*3, and a flexible curved portion 38*a*2 or 38*b*2.

The clamp connecting portion 38*a*1 or 38*b*1 may be connected to the clamp 36, and configured as a flat conductive member.

The terminal side connecting portion 38*a*3 or 38*b*3 may be connected to a terminal side, namely, the lower terminal 40 and configured as a flat conductive member.

The clamp connecting portion 38*a*1 or 38*b*1 and the terminal side connecting portion 38*a*3 or 38*b*3 may comprise a plurality of coupling hole portions 38*c* and 38*d*, respectively, for allowing coupling of fixing members including screws.

The flexible curved portion 38*a*2 or 38*b*2 may be connected between the clamp connecting portion 38*a*1 or 38*b*1 and the terminal side connecting portion 38*a*3 or 38*b*3, and configured to be projected outwardly.

The flexible shunt 38 may further comprise a shunt fixing block 39 made of a conductive material and interposed between the terminal side connecting portion 38*a*3 or 38*b*3 and the lower terminal 40 to connect the terminal connecting portion 38*a*3 or 38*b*3 to the lower terminal 40. Accordingly, even if there is a height difference between the terminal side connecting portion 38*a*3 or 38*b*3 and the lower terminal 40, the height difference can be overcome by virtue of the shunt fixing block 39, so as to facilitate the flexible shunt 38 and the lower terminal 40 to be electrically and mechanically connected to each other.

Hereinafter, description will be given of an operation of the main circuit part 30 in the vacuum circuit breaker having the flexible shunt 38, with reference to FIG. 3 and FIG. 4.

For driving toward the connected position as shown in FIG. 3, when a left end portion of the link 44, which is connected to a switching mechanism (not shown) as a driving unit located at the main body of FIG. 1, is moved down by a switching driving force from the switching mechanism, the push rod 42, which is connected at an eccentric position to the right of the link 44, is moved up, and in turn, the connection rod 41, whose lower end is connected to the connection rod 41, is moved up. Accordingly, the movable shaft 35*a* whose lower end is connected to the connection rod 41 is moved up. The movable contact 35 connected to an upper end of the movable shaft 35*a* thusly contacts the corresponding stationary contact 34 within the vacuum interrupter 33, so as for an electric current to flow on the circuit.

Figure 4:
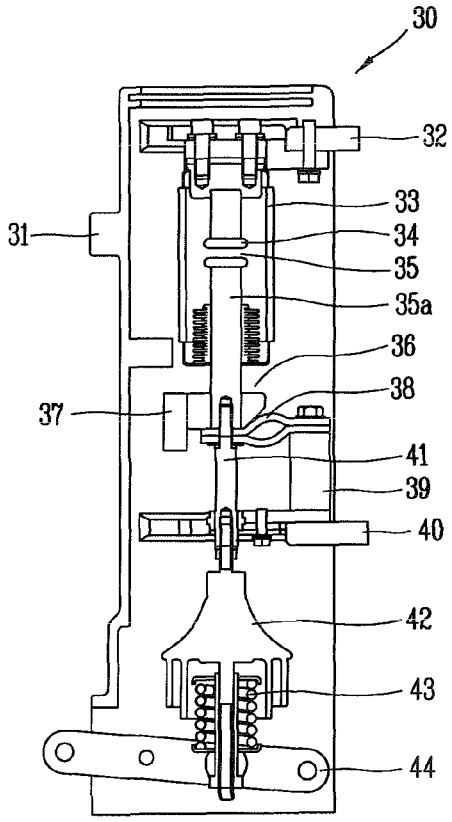
FIG. 4 is a longitudinal sectional view showing the flexible shunt and the related components of the main circuit part in the vacuum circuit breaker, which shows a separated state between the contacts.
Figure 5:
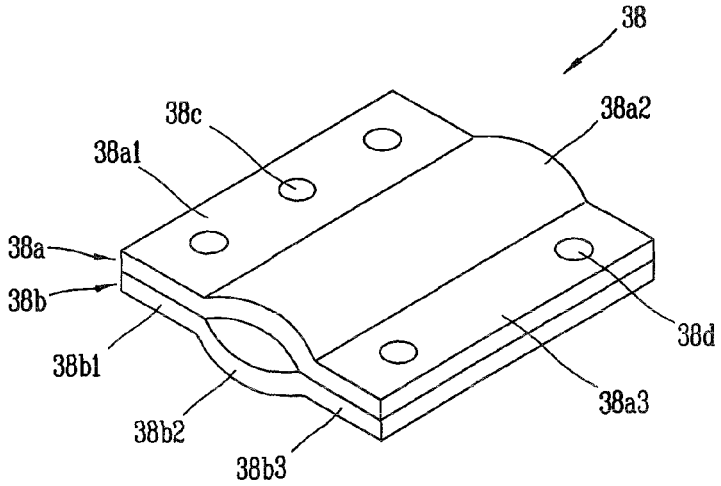
FIG. 5 is a perspective view showing the flexible shunt of the vacuum circuit breaker.

For driving toward the disconnected position as shown in FIG. 4, when the left end portion of the link 44, which is connected to the switching mechanism (not shown) as the driving unit located at the main body of FIG. 1, is moved up by the switching driving force from the switching mechanism, the push rod 42, which is connected at the eccentric position to the right of the link 44, is moved down, and in turn, the connection rod 41, whose lower end is connected to the push rod 42, is moved down. Accordingly, the movable shaft 35*a* whose lower end is connected to the connection rod 41 is moved down. The movable contact 35 connected to the upper end of the movable shaft 35*a* is thusly separated from the corresponding stationary contact 34 within the vacuum interrupter 33, so as to break the circuit.

As the movable shaft 35*a* is moved up or down upon the switching operation of the vacuum circuit breaker, the clamp 36 connected to the movable shaft 35*a* is moved up or down, and the clamp connecting portion 38*a*1 or 38*b*1 of the flexible shunt 38 connected to the clamp 36 is thusly moved up or down. Here, the flexible shunt 38 according to the present disclosure comprises the pair of conductive plates 38*a* and 38*b*. Each of the conductive plates 39*a* and 38*b* comprises the flexible curved portion 38*a*2 or 38*b*2 at the middle thereof, which provides an increased surface length of the flexible shunt 38 although its straight length is short. Hence, the flexible shunt can maintain flexibility by the long surface length due to the flexible curved portion 38*a*2 or 38*b*2 at the middle of the conductive plate 38*a* or 38*b*, in spite of an increase in thickness. Consequently, the clamp connecting portion 38*a*1 or 38*b*1 connected to the clamp 36 coupled to the movable shaft 35*a* can be flexibly movable.

With regard to the flexible shunt 38 for the vacuum circuit breaker according to the present disclosure, the clamp connecting portion 38*a*1 or 38*b*1 and the terminal side connecting portion 38*a*3 or 38*b*3 are provided with the plurality of coupling hole portions 38*c* and 38*d*, respectively, for allowing connection of the fixing members including the screws. Therefore, it can be effective to facilitate connection between the clamp 36 and the lower terminal 40.

The flexible shunt 38 for the vacuum circuit breaker according to the present disclosure may further comprise the shunt fixing block 39 made of the conductive material and interposed between the terminal side connecting portion 38*a*3 or 38*b*3 and the lower terminal 40. Accordingly, it is possible to overcome the height difference between the terminal side connecting portion 38*a*3 or 38*b*3 of the flexible shunt 38 and the lower terminal 40, thereby facilitating the electric connection between the flexible shunt 38 and the lower terminal 40.

With regard to the flexible shunt for the vacuum circuit breaker according to the present disclosure, each conductive plate 38*a*, 38*b* constructing the flexible shunt 38 is configured by stacking and pressing a plurality of electrically conductive thin plates. Hence, the flexible shunt 38 can exhibit excellent flexibility as compared to the thickness thereof.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A flexible shunt for a vacuum circuit breaker, the vacuum circuit breaker having a vacuum interrupter, a movable shaft, a heat sink, a clamp to connect the heat sink to the movable shaft, and a terminal connected to an electric power source side or an electric load side of an electric circuit, the flexible shunt comprising:

a pair of conductive plates, each of the pair of conductive plates comprising:

a clamp connecting portion connected to the clamp and comprising a flat conductive member;

a terminal side connecting portion connected to the terminal side and comprising a flat conductive member; and a flexible curved portion configured to connect the clamp connecting portion to the terminal side connecting portion, the flexible curved portion of each of the pair of conductive plates projected outwardly and away from the flexible curved portion of the other of the pair of conductive plates; and a shunt fixing block interposed between the terminal side connecting portion and the terminal in order to fix the terminal side connecting portion to the terminal and to overcome a height difference between the flexible shunt and the terminal, wherein the shunt fixing block is made of a conductive material for providing a conductive path from the flexible shunt to the terminal.

2. The flexible shunt of claim 1, wherein each of the clamp connecting portion and the terminal side connecting portion comprises a plurality of coupling hole portions for facilitating coupling of fixing members including screws.

3. The flexible shunt of claim 1, wherein each of the pair of conductive plates further comprises a plurality of electrically conductive thin plates that are stacked and pressed.

* * * * *